United States Patent [19]

Heims

[11] Patent Number: 4,986,695

[45] Date of Patent: Jan. 22, 1991

[54] LAYING PLANK FOR A ROAD FINISHING MACHINE

[75] Inventor: Dirk Heims, Bad Münder, Fed. Rep. of Germany

[73] Assignee: ABG-Werke GmbH, Fed. Rep. of Germany

[21] Appl. No.: 389,399

[22] Filed: Aug. 4, 1989

[30] Foreign Application Priority Data

Nov. 10, 1988 [DE] Fed. Rep. of Germany ..... 3838156

[51] Int. Cl.[5] ..... E01C 19/48

[52] U.S. Cl. ..... 404/118; 404/95; 404/104

[58] Field of Search ..... 404/118, 83, 85, 95, 404/104, 106

[56] References Cited

U.S. PATENT DOCUMENTS 4,129,399 12/1978 Ruge ..... 404/118
4,272,213 6/1981 McGovarin ..... 404/118
4,379,653 4/1983 Brown ..... 404/95 X

*Primary Examiner*—Stephen J. Novosad

*Attorney, Agent, or Firm*—Townsend and Townsend

[57] ABSTRACT

The invention relates to a laying plank for a road finishing machine, comprising a basic plank (1) which exhibits two central upright cheeks (2) to which a telescopic cylinder (3) is attached on each side which guides an inner movable cheek (8) of an extensible plank (4) for the lateral prolongation of the basic plank (1) and engages its outer movable cheek (5) for extension, guide rods (7) parallel to the cylinder axis being provided respectively between inner and outer cheeks (5,8) which are guided by an outer cheek (11) connected firmly to the basic plank (1). In order that the basic plank (1) can be enlarged practically to double width by the extensible planks, it is provided that the guide rods (7) are constructed as telescopic rods and the extensible planks (4) are respectively connected to an auxiliary cheek (6) adjacent to the inner movable cheek (8), the auxiliary cheeks (6) being respectively guided and retained by an auxiliary guide means (13, 14) fastened to the respective inner movable cheek (8), parallel to the cylinder axis and extending outwards.

3 Claims, 2 Drawing Sheets

LAYING PLANK FOR A ROAD FINISHING MACHINE

The invention relates to a laying plank for a road finishing machine.

Road finishing machines are generally equipped with a basic plank and with two extensible planks, the latter being extensible each to one side of the road finishing machine to conform to the width of the material to be laid. In this case, however, an enlargement to twice the width of the basic plank is prevented by the necessary guide and bracing means of the extensible planks.

The object of the invention is to develop a laying plank which permits an enlargement to each side by virtually half the width of the basic plank.

This object is achieved by a laying plank for a road finishing machine, comprising a basic plank which exhibits two central upright cheeks to which a telescopic cylinder is attached on each side which guides an inner movable cheek of an extensible plank for the lateral prolongation of the basic plank and engages its outer movable cheek for extension. Guide rods parallel to the cylinder axis are provided respectively between inner and outer cheeks which are guided by an outer cheek connected firmly to the basic plank. In order that the basic plank can be enlarged practically to double width by the extensible planks, it is provided that the guide rods are constructed as telescopic rods and the extensible planks are respectively connected to an auxiliary cheek adjacent to the inner movable cheek, the auxiliary cheek being respectively guided and retained by an auxiliary guide means fastened to the respective inner movable cheek parallel to the cylinder axis and extending outwards.

Further developments of the invention are to be found in the following description and in the subordinate claims.

The invention is explained more fully below with reference to the exemplary embodiment shown in the accompanying drawings.

Figure 1:
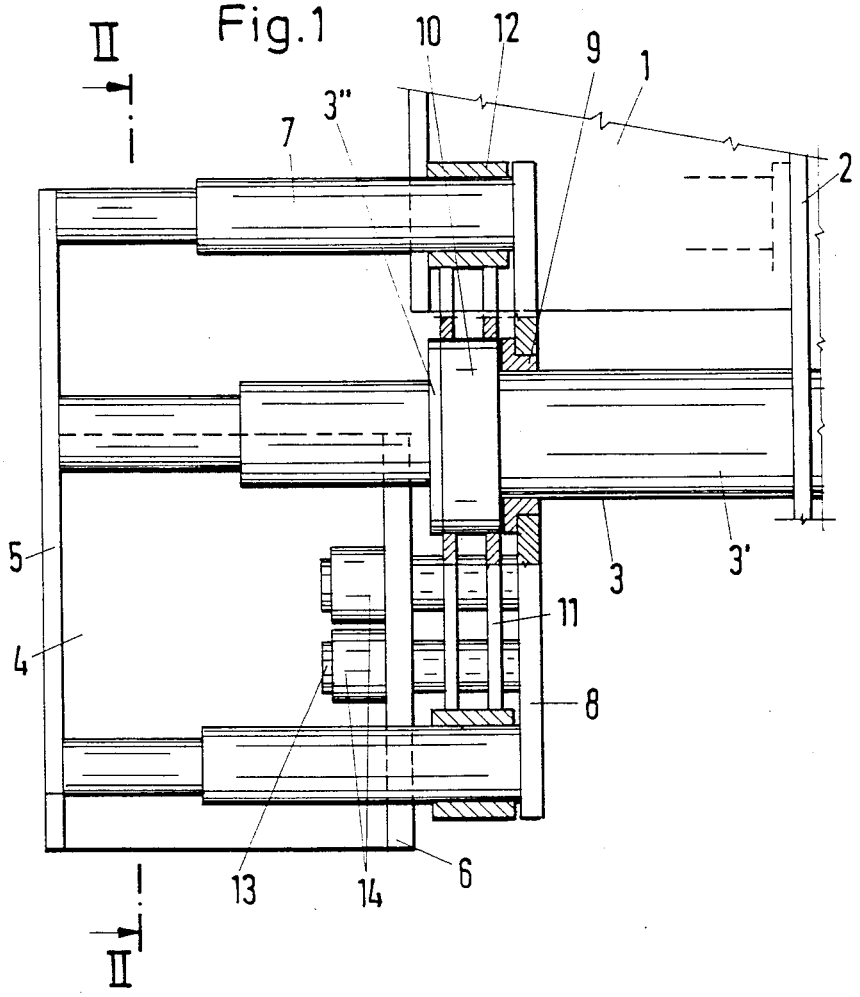
FIG. 1 shows a laying plank diagrammatically in plan and in detail.

The laying plank shown comprises a basic plank 1 of predetermined width, which is arranged on a road finishing machine and connected to two central upright cheeks 2, the main planes of which extend in the direction of travel of the road finishing machine. A telescopic cylinder 3 extending laterally outwards is fastened to each side of the central cheek 2, and they are connected with pressurized medium pipes, not shown, to retract and extend them. The two telescopic cylinders 3 serve to extend extensible planks 4 which are arranged behind the basic plank 1 in the retracted state and have half the width of the basic plank 1.

The extensible planks 4 are each provided with an outer movable cheek 5 which is engaged by the respective telescopic cylinder 3, and with an inner auxiliary cheek 6. The outer movable cheek 5 is connected by telescopic rods 7 to an inner movable cheek 8. The cheek 8 houses a bearing bushing 9 which embraces the telescopic cylinder 3 in the region of its outer tube 3' and ensures the guidance of the cheek 8 by the telescopic cylinder 3. The telescopic cylinder 3 is firmly connected at the free end of its outer tube 3' by a flange 3'' to an adjacent box 10 which is in turn connected to a cheek 11 formed by two parallel plates and fastened to the basic plank 1. The flange 3'' is conveniently set back by the thickness of the cheek 5 relative to the outer edge of the basic plank 1, so that when the extensible plank 4 is retracted its outer edge is aligned with that of the basic plank 1.

The cheek 11 supports a guide sleeve 12 in each case in front of and behind the telescopic cylinder 3, one for each of the telescopic rods 7, the axes of which extend parallel to the axis of the telescopic cylinder 3.

At least two guide rods 13, or another equivalent guide means, which extend parallel to the axis of the telescopic cylinder 3 towards the outer cheek 5, are fastened to the inner movable cheek 8. The auxiliary cheek 6 has two guide sleeves 14 which embrace the guide rods 13. The auxiliary cheek 6 and the guide rods 13 are arranged beneath the cheek 11, so that in the retracted state of the extensible plank 4 the auxiliary cheek 6 comes virtually into abutment with the inner cheek 8. The telescopic rods 7 are retracted in this position.

The axes of the telescopic cylinder 3 and of the telescopic rods 7 are conveniently, like the axes of the guide rods 13, staggered mutually in the vertical direction in order to achieve greater stability and rigidity.

Figure 2:
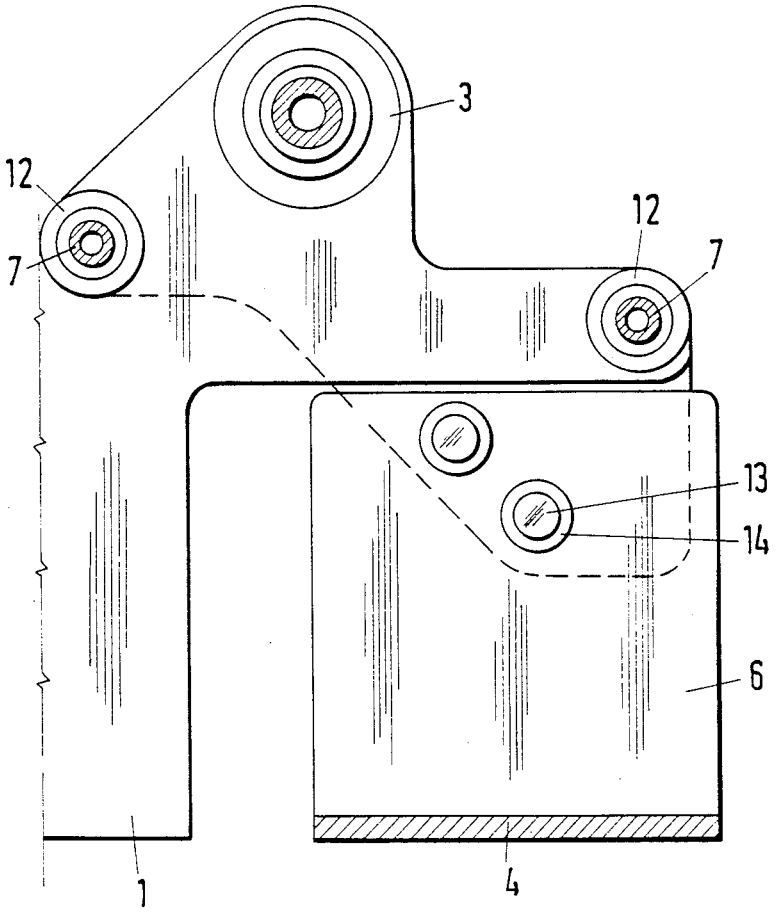
FIG. 2 shows a section along the line II—II of FIG. 1.

Due to the auxiliary cheek 6 guided by the guide rods 13, it is possible to extend the extensible planks 4 substantially by half the width of the basic plank 1, and thus to double the width of the basic plank 1. As FIG. 2 shows, the auxiliary cheek 6 is movable through beneath the cheek 13, so that the retraction and extension of the extensible plank 4 is not impeded.

The telescopic cylinder 3 may exhibit a sequence circuit for the consecutive extension and retraction of its sections, however this may also be omitted. The section with the lowest friction then retracts or extends first.

I claim:

1. Laying plank for a road finishing machine comprising:

a centrally divided basic plank, one of the respective left-hand or right-hand half of which exhibits a central upright cheek to which an extending cylinder is attached on each side which guides an inner movable cheek of an extensible plank for the lateral prolongation of the basic plank and engages an outer movable cheek of said extensible plank for extension;

guide rods parallel to the cylinder axis being provided respectively between said inner and outer cheeks which are guided by an outer cheek connected firmly to the basic plank;

auxiliary cheeks, adjacent to the inner movable cheek, respectively connected to the extensible planks;

auxiliary guide means fastened to the inner movable cheek, parallel to the cylinder axis, and extending downwards; and the guide rods being constructed as telescopic rods and the auxiliary cheeks being respectively guided and retained by the respective auxiliary guide means fastened to the respective inner movable cheek.

2. Laying plank according to claim 1, characterized in that the auxiliary guide means comprises at least two guide rods.

3. Laying plank according to claim 2, characterized in that the guide rods are arranged mutually staggered in a vertical direction.

* * * * *